US009103242B2

(12) United States Patent
Sugiura

(10) Patent No.: US 9,103,242 B2
(45) Date of Patent: Aug. 11, 2015

(54) VALVE TIMING ADJUSTMENT APPARATUS

(71) Applicant: DENSO CORPORATION, Kariya, Aichi-pref. (JP)

(72) Inventor: Taei Sugiura, Anjo (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 14/302,874

(22) Filed: Jun. 12, 2014

(65) Prior Publication Data

US 2014/0366824 A1 Dec. 18, 2014

(30) Foreign Application Priority Data

Jun. 14, 2013 (JP) ..... 2013-125970

(51) Int. Cl.
*F01L 1/34* (2006.01)
*F01L 1/352* (2006.01)

(52) U.S. Cl.
CPC ..... *F01L 1/352* (2013.01); *F01L 2250/02* (2013.01); *F01L 2810/02* (2013.01); *F01L 2820/032* (2013.01)

(58) Field of Classification Search
CPC . F01L 1/352; F01L 2820/032; F01L 2810/02; F01L 2250/02
USPC ..... 123/90.17
See application file for complete search history.

(56) References Cited

U.S. PATENT DOCUMENTS 7,703,425 B2 * 4/2010 Schafer et al. ..... 123/90.17
2007/0202981 A1 8/2007 Sugiura et al.

* cited by examiner

*Primary Examiner* — Zelalem Eshete
(74) *Attorney, Agent, or Firm* — Nixon & Vanderhye PC

(57) ABSTRACT

A planetary carrier supports a geared rotor from an inside in a radial direction, and receives a radial load in a first region, which is offset to one end from a center position in an axial direction. A ball bearing roller supports the planetary carrier from an outside in the radial direction in a second region, which is offset to an other end from the center position. The ball bearing roller is a single-row ball bearing roller that has an outer ring supported by a drive rotor, an inner ring which supports the planetary carrier, and a plurality of rolling elements which are rotatably installed in a single row to be in contact with and between the outer and the inner rings. The geared rotor is tilted relative to the axial direction, and contacts a driven rotor in the axial direction. An angle of the geared rotor relative to the axial direction is set to be smaller than a maximum allowable angle at which the inner ring is allowed to be tilted relative to the axial direction.

5 Claims, 7 Drawing Sheets

VALVE TIMING ADJUSTMENT APPARATUS

CROSS REFERENCE TO RELATED APPLICATION

This application is based on and incorporates herein by reference Japanese Patent Application No. 2013-125970 filed on Jun. 14, 2013.

TECHNICAL FIELD

The present disclosure relates to a valve timing adjustment apparatus that adjusts valve timing of a valve which is opened and closed by a cam shaft by transmission of a torque from a crank shaft in an internal combustion engine.

BACKGROUND

In the related art, a valve timing adjustment apparatus adjusts a relative phase (hereinafter, referred to as a "rotor-to-rotor phase") between first and second rotors. The first and second rotors are coupled with a crank shaft and a cam shaft through a planetary motion of a geared rotor and respectively rotate.

In a type of the apparatus disclosed in JP 4442574 B, a planetary carrier supports the geared rotor from the inside in a radial direction, which meshes with a first gear portion of the first rotor and a second gear portion of the second rotor. In particular, the first rotor is supported from the outside in the radial direction by ball bearing rollers which are mounted on the second rotor to interpose the first rotor on both sides in an axial direction. As a result, the planetary carrier is tilted relative to the axial direction within a range of an internal clearance of the bearing.

In the apparatus disclosed in JP 4442574 B, the planetary carrier receives a radial load in a first region that is offset in the axial direction to one end from a center position, and the planetary carrier is supported by the ball bearing rollers in a second region that is offset to the other end from the center position. Accordingly, when the planetary carrier receives the radial load in the first region, the planetary carrier is tilted around a specific point as a center point in the second region. The geared rotor supported by the planetary carrier is tilted together with the planetary carrier, and thus the geared rotor undergoes increasing wear due to gear rattle occurring at locations at which the geared rotor meshes with the first and the second gear portions. Accordingly, from the viewpoint of durability the amount of tilt is required to be regulated.

Herein, in the ball bearing roller of the apparatus disclosed in JP 4442574 B, a plurality of rolling elements arranged in two rows are installed between an outer ring mounted on the second rotor and an inner ring that supports the planetary carrier. With the plurality of rows of rolling elements, when the inner ring and the planetary carrier is tilted relative to the axial direction, the tilting of the inner ring is received by the outer ring through each rolling element in two circumferences that are apart in the axial direction from each other. Effects of tilt regulation by the stop structure become great. However, since either a total contact area between the outer ring and the entirety of the rolling elements or a total contact area between the inner ring and the entirety of the rolling elements becomes large, a contact pressure occurs in a large area of a contact interface when the tilt is regulated. As a result, wear increases in the ball bearing roller, the inner ring of which is tilted, thereby causing a reduced lifespan and reduced durability.

SUMMARY

The present disclosure is made in light of the problems described above, and an object of the present disclosure is to provide a valve timing adjustment apparatus with high durability.

In an aspect of the present disclosure, a valve timing adjustment apparatus is for adjusting valve timing of a valve that is opened and closed by a rotation of a cam shaft. The cam shaft is rotated by torque transmitted from a crank shaft in an internal combustion engine.

The valve timing adjustment apparatus includes a first rotor having a first gear portion and rotatably coupled with one of the crank shaft or the cam shaft, a second rotor having a second gear portion and interposing the first rotor on both sides in an axial direction, the second rotor rotatably coupled with an other of the crank shaft or the cam shaft, and a geared rotor meshing with the first gear portion and the second gear portion and moving in planetary motion to adjust a relative phase between the first rotor and the second rotor. The apparatus further includes a planetary carrier supporting the geared rotor in a radial direction from an inside of the geared rotor, and receiving a radial load in a first region which is offset to one end from a center position of the planetary carrier in the axial direction, and a ball bearing roller that is supported by the second rotor and supports the planetary carrier in the radial direction from an outside of the planetary carrier in a second region which is offset to an other end from the center position of the planetary carrier in the axial direction.

The ball bearing roller is a single-row ball bearing roller that has an outer ring supported by the second rotor, an inner ring that supports the planetary carrier, and a plurality of ball bearings that are rotatably installed in a single row to be in contact with and between the outer ring and the inner ring.

The geared rotor is tilted relative to the axial direction and contacts the first rotor or the second rotor in the axial direction.

An angle of the geared rotor relative to the axial direction is set to be smaller than a maximum allowable angle at which the inner ring is allowed to be tilted relative to the axial direction.

According to an aspect of the present disclosure, the planetary carrier receives the radial load in the first region that is offset to one end from the center position in the axial direction. The ball bearing roller supports the planetary carrier in the second region that is offset to the other end from the center position. Accordingly, when the planetary carrier receives the radial load in the first region, the planetary carrier is angled around a specific point as a center point in the second region.

Here, the ball bearing roller has a structure in which the plurality of rolling elements are installed in only a single row between the outer ring mounted on the second rotor and the inner ring that supports the planetary carrier. Accordingly, in the single-row ball bearing roller, when the planetary carrier and the inner ring are tilted relative to the axial direction, the tilt of the inner ring is received by the outer ring through the rolling elements in a single circumference, and thus effects of tilt regulation becomes small. At this time, the geared rotor supported from the inside in the radial direction by the planetary carrier also is tilted relative to the axial direction, and thus the geared rotor is brought into contact with the first rotor or the second rotor that supports the first rotor. Since the effects of tilt regulation can be realized by the contact, the geared rotor is unlikely to undergo gear rattle at the locations where the geared rotor meshes with the first and the second gear portions. At this time, the geared rotor is tilted together with the planetary carrier and the inner ring at the angle which is smaller than the maximum allowable angle of the inner ring. When the angle of the geared rotor is small, even in the single-row ball bearing roller in which both a total contact area between the outer ring and the entirety of the rolling elements and a total contact area between the inner ring and the entirety of the rolling elements are small, a contact pressure occurring in a small area of a contact interface can be made small.

In this manner, wear can be prevented from occurring at the locations where the sloping geared rotor meshes with each gear portion. Wear can be also prevented from occurring in the ball bearing roller, the inner ring of which is tilted, thereby being able to improve durability of the entire apparatus.

In another aspect of the present disclosure, the geared rotor is eccentric with respect to the first rotor and the second rotor, and an outermost circumferential angled portion in on eccentric side of the geared rotor is brought into elastic contact with the first rotor or the second rotor. The planetary carrier has a supporting surface coaxial with the first rotor and the second rotor and supports the inner ring with the supporting surface. A radius between a rotational center line of the first rotor and the second rotor and the outermost circumferential angled portion is set to be greater than a radius between the rotational center line and the supporting surface.

According to the aspect of the present invention, the radius between the rotational center line and the outermost circumferential angled portion is set to be greater than the radius between the rotational center line and the supporting surface of the planetary carrier. The outermost circumferential angled portion on the eccentric side of the geared rotor is brought into elastic contact with the first rotor or the second rotor due to the eccentricity of the geared rotor with respect to the first and the second rotors. Accordingly, a large contact area can be ensured, and thus the contact pressure can be suppressed. As a result, wear of the contact interface can be suppressed. In contrast, in the single-row ball bearing roller, the inner ring is supported by the supporting surface, which has the radius from the rotational center line smaller than the radius between the rotational center line and the outermost circumferential angled portion of the geared rotor. Therefore, when the inner ring is tilted together with the planetary carrier, the amount of thrust which causes the inner ring to be offset with respect to the outer ring can be reduced. Here, in particular, in the contact interface between the outer ring and the rolling elements and the contact interface between the inner ring and the rolling elements, wear caused by the offset of the inner ring can be suppressed by the reduction of the amount of thrust. The aforementioned configuration can contribute to an improvement in durability.

BRIEF DESCRIPTION OF THE DRAWINGS

The disclosure, together with additional objectives, features and advantages thereof, will be best understood from the following description, the appended claims and the accompanying drawings, in which:

Hereinafter, a plurality of embodiments of the present disclosure will be described with reference to the accompanying drawings. In each embodiment, the same reference signs are assigned to corresponding configuration elements, and there is a case where duplicated descriptions are omitted. In each embodiment, when only a part of a configuration of an embodiment is described, a corresponding configuration of another embodiment, which is previously described, is applicable to the other part of the configuration of the embodiment. Insofar as there are no problems with a combination of the configurations, not only can the configurations be combined together as stated in each embodiment, but also the configurations of the plurality of embodiments can be partially combined together even though the partial combinations of the configurations are not stated.

(First Embodiment)

Figure 1:
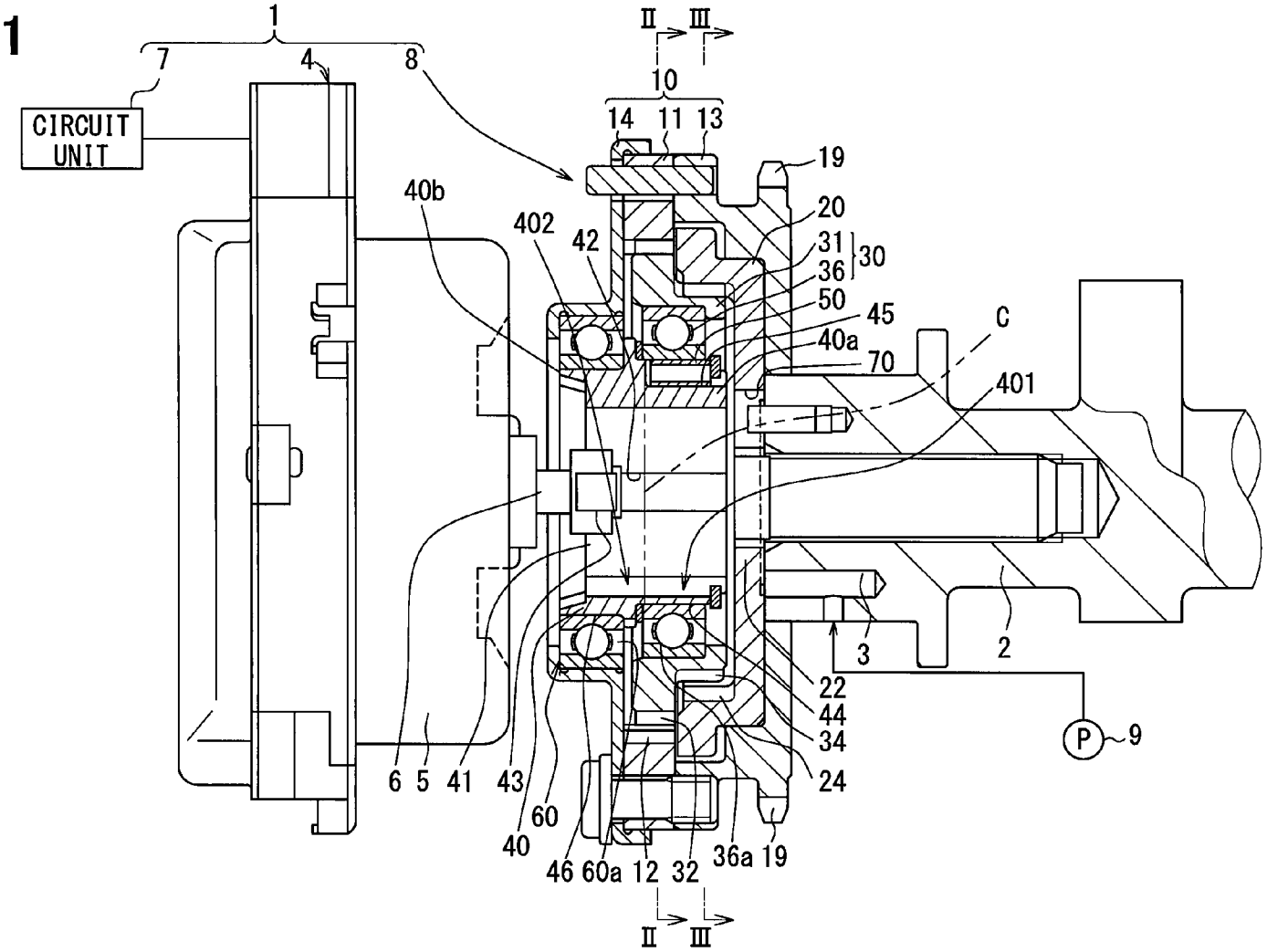
FIG. 1 is a view illustrating a valve timing adjustment apparatus according to First Embodiment, and is a cross-sectional view taken along line I-I in FIG. 2.

As illustrated in FIG. 1, a valve timing adjustment apparatus 1 according to First Embodiment of the present disclosure is installed in a transmission system that transmits a crank torque from a crank shaft (not illustrated) to a cam shaft 2 in an internal combustion engine of a vehicle. In the embodiment, the cam shaft 2 opens and closes an intake valve (not illustrated) among "valves" of the internal combustion engine through the transmission of the crank torque, and the apparatus 1 adjusts valve timing of the intake valve.

(Basic Configuration)

Figure 2:
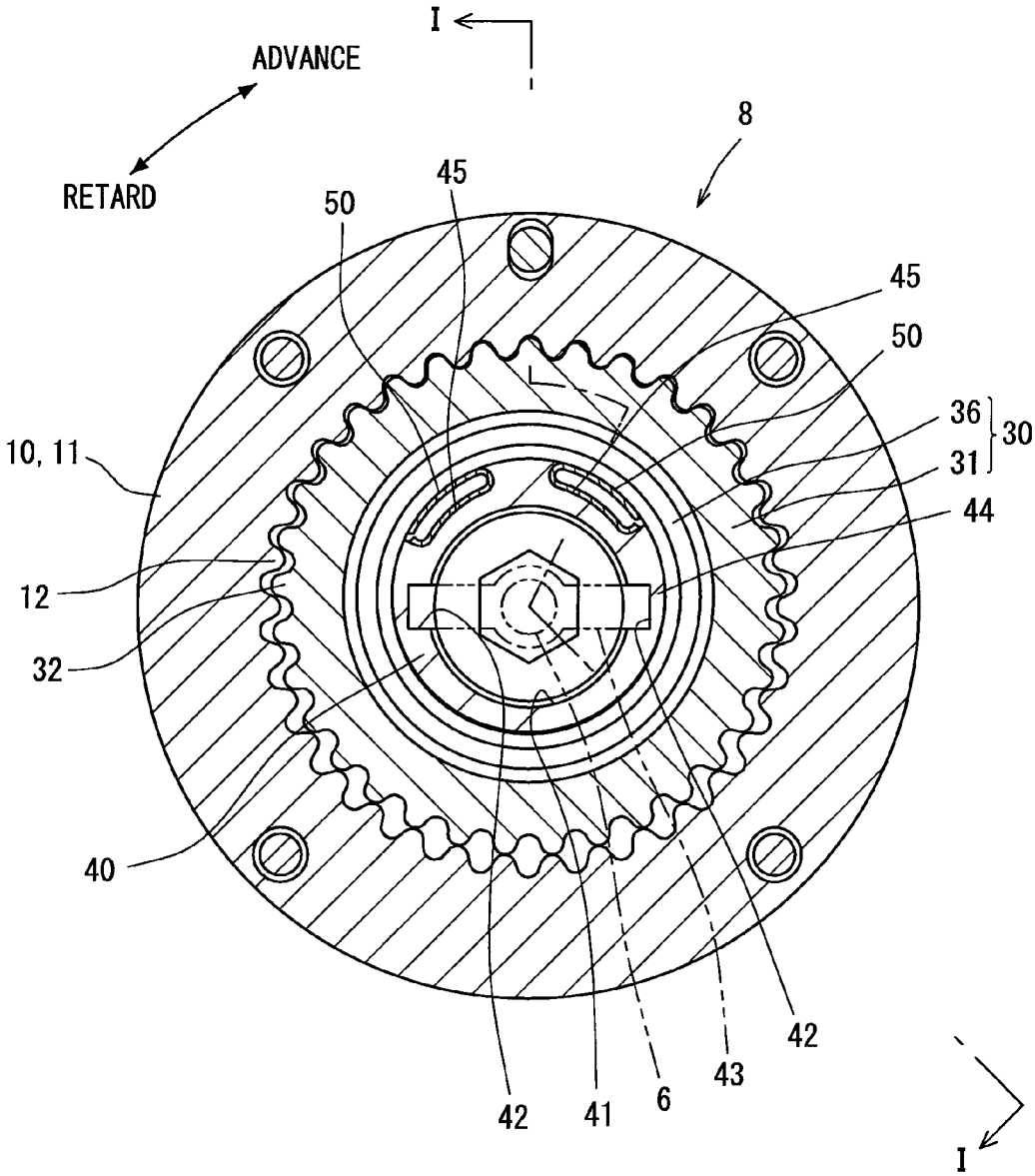
FIG. 2 is a cross-sectional view taken along line II-II in FIG. 1.
Figure 3:
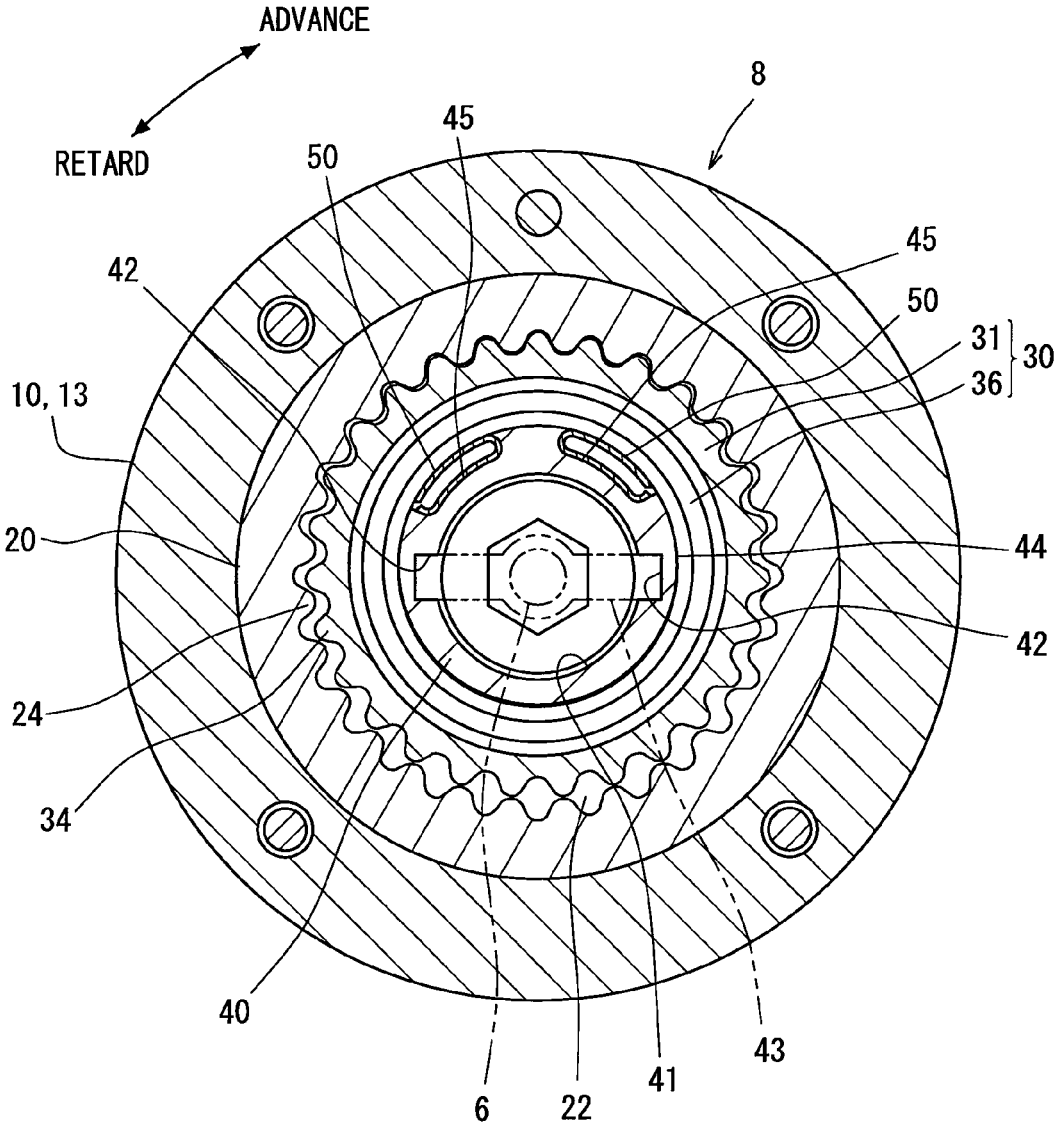
FIG. 3 is a cross-sectional view taken along line III-III in FIG. 1.

Hereinafter, a basic configuration of the apparatus 1 will be described. As illustrated in FIGS. 1 to 3, the apparatus 1 is configured to have an actuator 4, an electrification control circuit unit 7, a phase adjustment unit 8 and the like.

For example, the actuator 4 which is illustrated in FIG. 1 is an electrically driven brushless motor, and has a housing body 5 and a control shaft 6. The housing body 5 is fixed to a fixed joint of the internal combustion engine, and the housing body 5 supports the control shaft 6 that can rotate in both circumferential directions (in a clockwise direction and in a counterclockwise direction in FIGS. 2 and 3). For example, the electrification control circuit unit 7 is configured to have a driving driver, a micro computer for control of the driving driver and the like. The electrification control circuit unit 7 is disposed outside and/or inside the housing body 5. The electrification control circuit unit 7 drives a rotation of the control shaft 6 by controlling electrification of the actuator 4 that is electrically connected to the electrification control circuit unit 7.

The phase adjustment unit 8 includes a drive rotor 10, a driven rotor 20, a geared rotor 30, a planetary carrier 40, an elastic member 50 and a ball bearing roller 60.

As illustrated in FIGS. 1 to 3, the hollow metallic drive rotor 10 accommodates the other configuration elements 20, 30, 40, 50 and 60 of the phase adjustment unit 8 therein. The drive rotor 10 tightens a sun gear member 11, a sprocket member 13 and a cover member 14 together in a state where the sun gear member 11 is interposed between the sprocket member 13 and the cover member 14.

As illustrated in FIGS. 1 and 2, a drive inner gear portion 12 is formed on an inner circumferential surface of a circumferential wall portion of the annular plate-shaped sun gear member 11, and the drive inner gear portion 12 has an addendum circle which is present inward from a root circle in a radial direction. As illustrated in FIG. 1, a plurality of sprocket teeth 19 are formed on an outer circumferential surface of a circumferential wall portion of the bottomed cylindrical sprocket member 13, and the sprocket teeth 19 protrude outward from locations of the sprocket member 13, which are apart from each other at equal intervals in the circumferential direction. A timing chain (not illustrated) is suspended between the sprocket teeth 19 and a plurality of sprocket teeth of the crank shaft, and thus the sprocket member 13 is connected to the crank shaft. When the crank torque of the crank shaft is transmitted to the sprocket member 13 through the timing chain, the connection allows the drive rotor 10 to rotate in a constant circumferential direction (in the clockwise direction in FIGS. 2 and 3) in conjunction with the crank shaft.

As illustrated in FIGS. 1 and 3, the bottomed cylindrical metallic driven rotor 20 is coaxially fitted into the sprocket member 13, and thus the drive rotor 10 is supported from the inside in the radial direction by the driven rotor 20. The driven rotor 20 is interposed in an axial direction between the sun gear member 11 and the sprocket member 13. A connection portion 22 is formed on a bottom wall portion of the driven rotor 20 to be coaxially connected to the cam shaft 2. The connection allows the driven rotor 20 to rotate in the same circumferential direction (in the clockwise direction in FIG. 3) as that of the drive rotor 10, and the driven rotor 20 can rotate relative to the drive rotor 10 in both circumferential directions.

A driven inner gear portion 24 is formed on an inner circumferential surface of a circumferential wall portion of the driven rotor 20, and the driven inner gear portion 24 has an addendum circle which is present inward from a root circle in the radial direction. The driven inner gear portion 24 is disposed to be offset in the axial direction from the drive inner gear portion 12. The driven inner gear portion 24 is set to have an inner diameter smaller than that of the drive inner gear portion 12. The driven inner gear portion 24 is set to have the number of teeth less than that of the drive inner gear portion 12.

As illustrated in FIGS. 1 to 3, the metallic geared rotor 30 is disposed in the radial direction from the inside of the sprocket member 13 and the driven rotor 20 to the inside of the sun gear member 11. The geared rotor 30 is an assembly of a planetary geared member 31 and a planetary bearing 36.

The stepped annular plate-shaped planetary geared member 31 is eccentrically disposed with respect to the rotors 10, 20 and the control shaft 6. A drive outer gear portion 32 and a driven outer gear portion 34 are formed on an outer circumferential surface of a circumferential wall portion of the planetary geared member 31. Each of the drive outer gear portion 32 and the driven outer gear portion 34 has an addendum circle which is present inward from a root circle in the radial direction. The drive outer gear portion 32 meshes with the drive inner gear portion 12 in such a manner that a meshing position of the drive outer gear portion 32 is eccentrically located in the radial direction with respect to the rotors 10 and 20. The driven outer gear portion 34 is disposed to be offset in the axial direction from the drive outer gear portion 32. The driven outer gear portion 34 is set to have an outer diameter smaller than that of the drive outer gear portion 32. The driven outer gear portion 34 is set to have the number of teeth less than that of the drive outer gear portion 32. The driven outer gear portion 34 meshes with the driven inner gear portion 24 in such a manner that a meshing position of the driven outer gear portion 34 is eccentrically located in the radial direction with respect to the rotors 10 and 20.

In the embodiment, the planetary bearing 36 is a single-row ball bearing roller, and is eccentrically disposed with respect to the rotors 10 and 20 and the control shaft 6. The planetary bearing 36 is coaxially fitted into the planetary geared member 31, and thus the planetary bearing 36 is retained by the planetary geared member 31.

The partially eccentric cylindrical metallic planetary carrier 40 is disposed in the radial direction from the inside of the sprocket member 13 and the driven rotor 20 to the inside of the cover member 14. A cylindrical input surface 41 is formed on an inner circumferential surface of a circumferential wall portion of the planetary carrier 40. The input surface 41 is coaxial with the rotors 10 and 20 and the control shaft 6. The input surface 41 is provided with connection grooves 42 that are fitted into a coupler 43, and the control shaft 6 is connected to the planetary carrier 40 through the coupler 43. The connection allows the planetary carrier 40 to rotate in the circumferential direction integrally with the control shaft 6, and the planetary carrier 40 can rotate in both circumferential directions relative to the drive inner gear portion 12.

A cylindrical eccentric surface 44 is formed on an outer circumferential surface of the circumferential wall portion of the planetary carrier 40, and the eccentric surface 44 is eccentric with respect to the rotors 10 and 20 and the control shaft 6. The eccentric surface 44 is provided across the following two regions in the planetary carrier 40: a first region 401 that is offset to one end 40*a* from a center position C in the axial direction, and a second region 402 that is offset to the other end 40*b* from the position C. In practicality, the planetary bearing 36 is coaxially fitted onto the eccentric surface 44 in the first region 401, and thus the planetary bearing 36 is installed in the radial direction between the planetary carrier 40 and the planetary geared member 31. The installation allows the planetary carrier 40 to support the geared rotor 30 from the inside in the radial direction, and thus the geared rotor 30 can move in planetary motion. The planetary motion is defined as such a motion that the geared rotor 30 rotates in the circumferential direction, and revolves in a rotational direction of the control shaft 6 and the planetary carrier 40.

Figure 4:
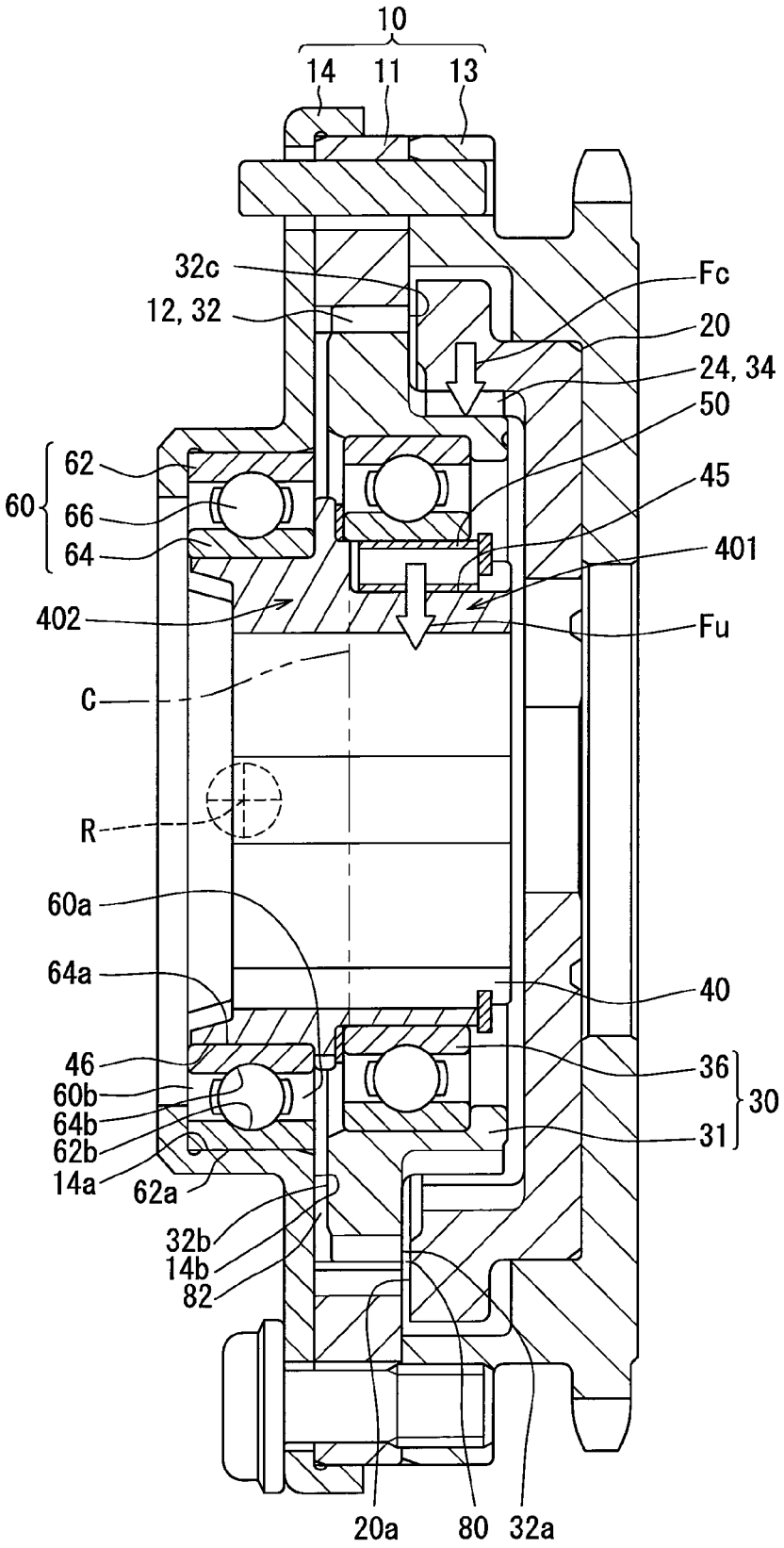
FIG. 4 is a cross-sectional view illustrating enlarged main portions in FIG. 1.

Here, the side toward which the respective outer gear portions 32 and 34 are eccentric with respect to the inner gear portions 12 and 24 (the upper side of FIG. 1) substantially coincide with the side toward which the eccentric surface 44 is eccentric with respect to the rotors 10 and 20 and the control shaft 6, and hereinafter, a side toward which a portion is eccentric with respect to another portion is simply referred to as an "eccentric side". A cam torque transmitted from the cam shaft 2 to the driven rotor 20 by a reaction force of an intake valve spring is converted into a force based on a pressure angle at locations at which the gear portions 24 and 34 mesh with each other as illustrated in FIG. 4. Accordingly, a radial load Fc occurs toward a direction opposite to the eccentric side. As a result, the eccentric surface 44 of the planetary carrier 40 receives the radial load Fc in the first region 401.

As illustrated in FIG. 1, a cylindrical supporting surface 46 is formed on the outer circumferential surface of the circumferential wall portion of the planetary carrier 40, and the supporting surface 46 is coaxial with the rotors 10 and 20 and the control shaft 6. The supporting surface 46 is provided in the second region 402 that is offset by the planetary carrier 40 to the other end 40*b* from the center position C in the axial direction.

As illustrated in FIGS. 1 to 3, the metallic elastic member 50 is individually accommodated in each of accommodating holes 45 that are open at two circumferential locations of the eccentric surface 44 in the first region 401. Each elastic member 50 is a leaf spring generally with a U-shaped cross section. A resultant force of a biasing force (a restoring force) caused by an elastic deformation of each elastic member 50 is exerted on the geared rotor 30 toward the eccentric side while the resultant force is exerted on the planetary carrier 40 in the direction opposite to the eccentric side. As a result, as illustrated in FIG. 4, the resultant force of the biasing force of each elastic member 50 becomes the radial load that each of the inner gear portions 12 and 24 receives at the locations at which the inner gear portions 12 and 24 mesh with the outer gear portions 32 and 34, respectively. The resultant force becomes a radial load Fu that an inner bottom surface of the accommodating hole 45 receives in the first region 401.

As illustrated in FIGS. 1 and 4, the single-row metallic ball bearing roller 60 is coaxially fitted into a cylindrical portion of the hat-shaped cover member 14, and thus the ball bearing roller 60 is retained by the drive rotor 10. The ball bearing roller 60 is coaxially fitted onto the supporting surface 46, and is installed in the radial direction between the planetary carrier 40 and the drive rotor 10. The installation allows the ball bearing roller 60 to rotatably support the planetary carrier 40 from the outside in the radial direction.

The phase adjustment unit 8 with the aforementioned configuration adjusts a phase of the driven rotor 20 relative to the drive rotor 10 as a rotor-to-rotor phase based on a rotational state of the control shaft 6. The valve timing becomes timing appropriate for an operation condition of the internal combustion engine by the adjustment of the rotor-to-rotor phase.

Specifically, when the control shaft 6 rotates with the drive rotor 10 at the same speed, and thus the planetary carrier 40 does not rotate relative to the drive inner gear portion 12, the geared rotor 30 does not undergo the planetary motion, and the geared rotor 30 rotates with the rotors 10 and 20. As a result, the rotor-to-rotor phase and the valve timing is adjusted to be maintained. In contrast, when the control shaft 6 rotates at a low speed or in a reverse direction relative to the drive rotor 10, and thus the planetary carrier 40 rotates in a cam retard direction relative to the drive inner gear portion 12, the geared rotor 30 undergoes the planetary motion, and the driven rotor 20 rotates in the cam retard direction relative to the drive rotor 10. As a result, the rotor-to-rotor phase and the valve timing is adjusted to be retarded. In contrast, when the control shaft 6 rotates at a speed higher than that of the drive rotor 10, and thus the planetary carrier 40 rotates in a cam advance direction relative to the drive inner gear portion 12, the geared rotor 30 undergoes the planetary motion, and the driven rotor 20 rotates in the cam advance direction relative to the drive rotor 10. As a result, the rotor-to-rotor phase and the valve timing is adjusted to be advanced.

(Details of Configuration)

Hereinafter, the configuration of the valve timing apparatus 1 will be described in more detail.

As illustrated in FIG. 4, in the ball bearing roller 60, a plurality of ball bearings 66 are installed in a single row between an outer ring 62 and an inner ring 64. An outer circumferential surface 62*a* of the outer ring 62 is coaxially fitted and mounted onto an inner circumferential surface 14*a* of the cylindrical portion of the cover member 14. An inner circumferential surface 64*a* of the inner ring 64 is coaxially fitted on to support the supporting surface 46. An inner circumferential surface 62*b* of the outer ring 62 and an outer circumferential surface 64*b* of the inner ring 64 function as raceway surfaces 62*b* and 64*b*, respectively, which are rotatably in contact with the entirety of the ball bearings 66. In the ball bearing roller 60, the ball-shaped ball bearings 66 are interposed between the raceway surfaces 62*b* and 64*b* which are open on both ends 60*a* and 60*b* in the axial direction. That is, in the embodiment, the ball bearing roller 60 is an open end type single-row ball bearing.

As illustrated in FIG. 1, a supply hole 70 is formed in the bottom wall portion of the driven rotor 20 to pass through the connection portion 22. One end of the supply hole 70 communicates with a transportation hole 3 of the cam shaft 2, and thus lubricant oil is supplied to the end of the supply hole 70 from a pump 9 driven by the crank torque. The other end of the supply hole 70 communicates with the inside of the drive rotor 10, and thus the lubricant oil is supplied into the rotor 10 from the pump 9. As a result, the lubricant oil supplied into the drive rotor 10 is introduced into the ball bearing roller 60 through an internal clearance and the like of the open end type planetary bearing 36 and the open end 60*a* located at a position at which the planetary bearing 36 is disposed.

Figure 5:
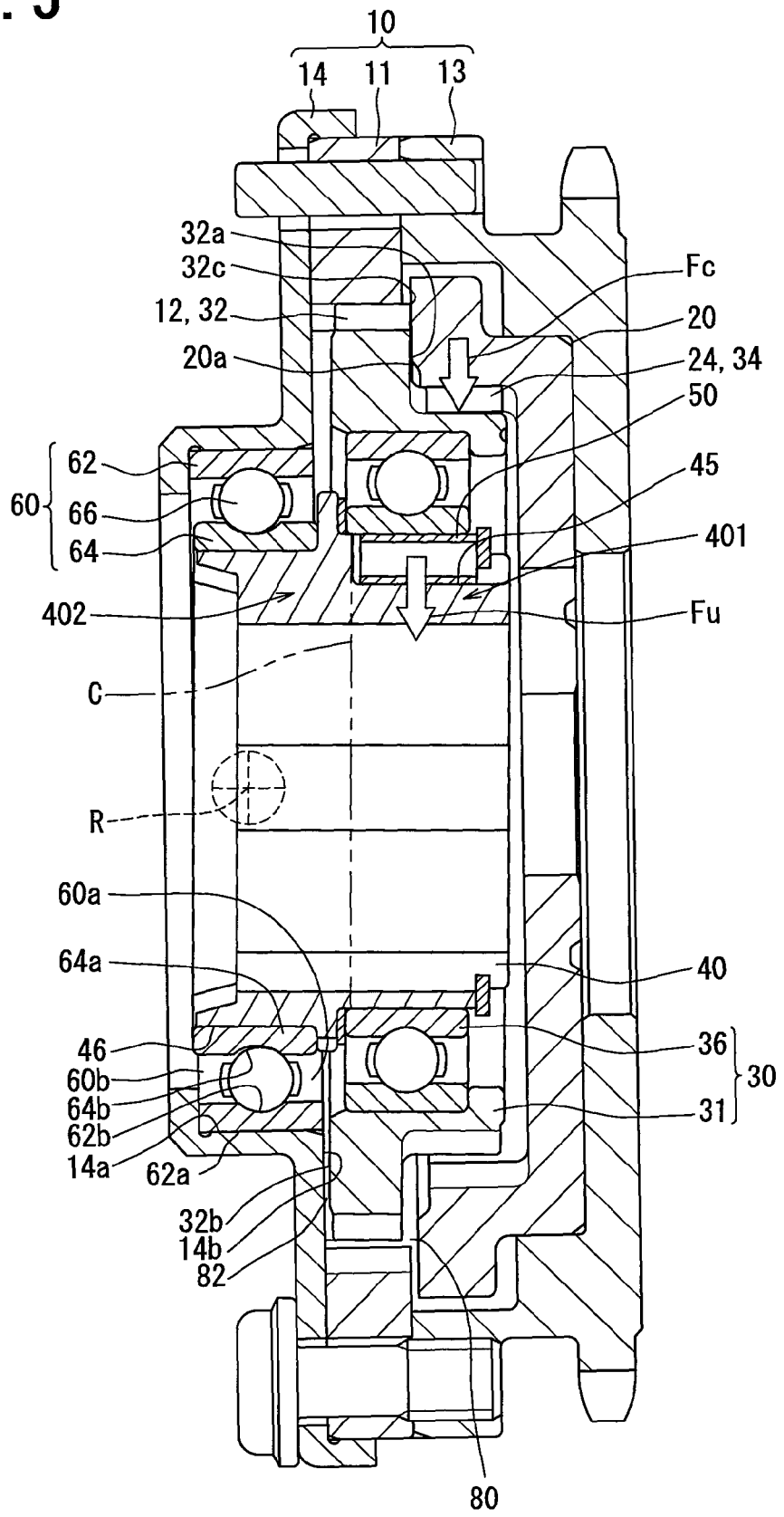
FIG. 5 is a cross-sectional view illustrating an operation state different from that in FIG. 4.
Figure 6:
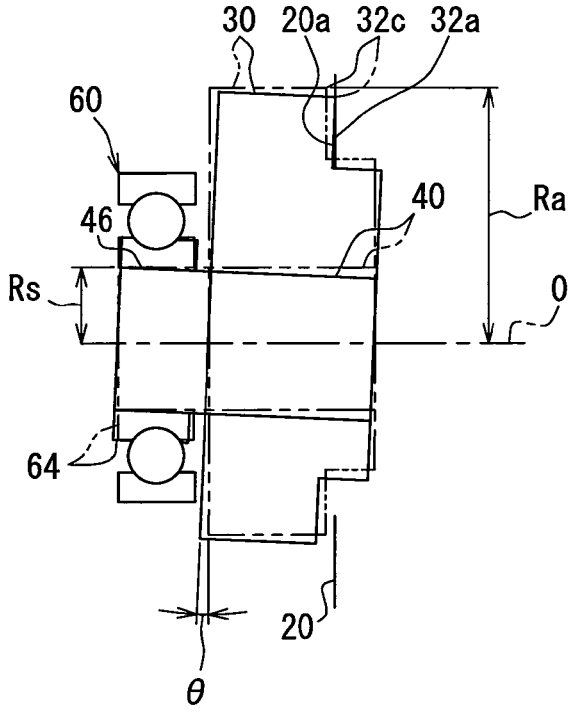
FIG. 6 is a schematic view describing characteristics of the main portions in FIG. 1.

In an initial state where the geared rotor 30 is not tilted as illustrated in FIG. 4, one end surface 32*a* of the drive outer gear portion 32 faces open end surface 20*a* of the circumferential wall portion of the driven rotor 20 in the axial direction. In this case, a clearance 80 is formed entirely in the rotational direction (in the circumferential direction) between the end surfaces 32*a* and 20*a*. In addition, in the initial state, the other end surface 32*b* of the drive outer gear portion 32 faces an end surface 14*b* of a flange portion of the cover member 14 in the axial direction. In this case, a clearance 82 greater than the clearance 80 is formed entirely in the rotational direction (in the circumferential direction) between the end surfaces 32*b* and 14*b*. Furthermore, in the initial state, the radial loads Fc and Fu caused by the cam torque or the biasing force are exerted on the planetary carrier 40 in the first region 401, and thus the planetary carrier 40 and the geared rotor 30 is tilted around a specific point R as a center point in the second region 402 as illustrated in FIGS. 5 and 6. Since the geared rotor 30 is tilted relative to the axial direction, an outermost circumferential angled portion 32*c* (refer to FIG. 4 as well) on the eccentric side of the end surface 32*a* is elastically deformed and is brought into contact with the open end surface 20*a*. That is, the outermost circumferential angled portion 32*c* of the end surface 32*a* of the geared rotor 30 is brought into elastic contact with the open end surface 20*a*.

Figure 7:
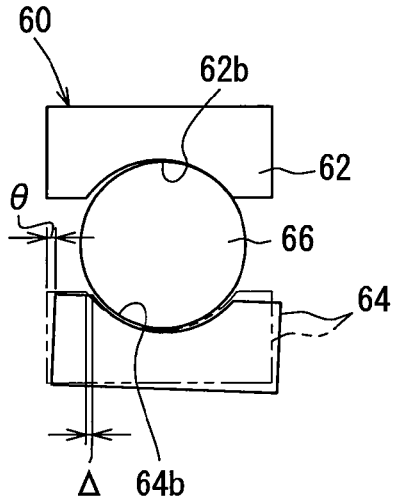
FIG. 7 is another schematic view describing the characteristics of the main portions in FIG. 1.

Here, as illustrated in FIG. 6, a radius Ra is a distance between the outermost circumferential angled portion 32*c* that is brought into contact with the open end surface 20*a* by the tilting and a rotational center line O of the rotors 10 and 20. A radius Rs is a distance between the supporting surface 46 and the rotational center line O. The radius Ra is set to be greater than the radius Rs. In addition, in the embodiment, when the outermost circumferential angled portion 32*c* is brought into contact with the open end surface 20*a*, as illustrated in FIGS. 6 and 7, the geared rotor 30 is set to be tilted together with the planetary carrier 40 and the inner ring 64 at an angle θ which is smaller than a maximum allowable angle of the inner ring 64 of the ball bearing roller 60. When the outer ring 62 of the ball bearing roller 60 is fixed, the maximum allowable angle is an angle at which the inner ring 64 is tilted relative to the axial direction, and is at an angle at which the inner ring 64 is allowed to tilt in advance. For example, when the inner ring 64 moves relative to the outer ring 62 by only a predetermined amount of thrust, the maximum allowable angle is determined based on the fact that the ball bearings 66 between the inner ring 64 and the outer ring 62 are interposed between both ends in the axial direction of the raceway surfaces 62*b* and 64*b*.

(Effects)

Hereinafter, effects of First Embodiment described above will be described.

In First Embodiment, the planetary carrier 40 receives the radial load in the first region 401 that is offset to one end 40*a* from the center position C in an axial direction, and the ball bearing roller 60 supports the planetary carrier 40 in the second region 402 that is offset to the other end 40*b* from the center position C. Accordingly, when the planetary carrier 40 receives the radial load in the first region 401, the planetary carrier 40 is tilted around the specific point R in the second region 402.

Here, the ball bearing roller 60 has a structure in which the plurality of ball bearings 66 are installed in a single row between the outer ring 62 that is mounted on the drive rotor 10 and the inner ring 64 that supports the planetary carrier 40. Accordingly, in the single-row ball bearing roller 60, when the planetary carrier 40 and the inner ring 64 is tilted relative to the axial direction, the tilt of the inner ring 64 is received (regulated) by the outer ring 62 through the ball bearings 66 in a single circumference, and thus effects of tilt regulation become small. At this time, the geared rotor 30 supported from the inside in the radial direction by the planetary carrier 40 also is tilted in the axial direction, and thus the geared rotor 30 is brought into contact with the driven rotor 20 in the axial direction. Since the effects of tilt regulation can be realized by the contact, the geared rotor 30 is unlikely to undergo gear rattle at the locations where the geared rotor 30 meshes with the driven inner gear portion 24. However, at this time, the geared rotor 30 is tilted together with the planetary carrier 40 and the inner ring 64 at the angle θ which is smaller than the maximum allowable angle of the inner ring 64. When the geared rotor 30 is tilted at the small angle θ, even in the single-row ball bearing roller in which both a total contact area between the outer ring 62 and the entirety of the ball bearings 66 and a total contact area between the inner ring 64 and the entirety of the ball bearings 66 are small, a large contact pressure can be prevented from occurring in a small area of a contact interface.

In this manner, wear can be prevented from occurring at the locations where the sloping geared rotor 30 meshes with the inner gear portions 12 and 24. Wear can be also prevented from occurring in the ball bearing roller 60 the inner ring 64 of which is tilted, thereby durability of the entire apparatus 1 can be improved.

The radius Ra between the rotational center line O and the outermost circumferential angled portion 32*c* is set to be greater than the radius between the rotational center line O and the supporting surface 46 of the planetary carrier 40. The outermost circumferential angled portion 32*c* in the eccentric side of the geared rotor 30 is brought into elastic contact with the driven rotor 20 due to the eccentricity of the geared rotor 30 with respect to the rotors 10 and 20. Accordingly, a large contact area can be ensured, and thus the contact pressure can be reduced. As a result, wear of the contact interface can be suppressed. In contrast, in the single-row ball bearing roller 60 in which the inner ring 64 is supported by the supporting surface 46 having the radius Rs from the rotational center line O, which is smaller than the radius between the rotational center line O and the outermost circumferential angled portion 32*c*. Therefore, when the inner ring 64 is tilted together with the planetary carrier 40, the amount of thrust Δ, which causes the inner ring 64 to be offset with respect to the outer ring 62 as illustrated FIG. 7, can be reduced. Here, in particular, in the contact interface between the outer ring 62 and the ball bearings 66 and the contact interface between the inner ring 64 and the ball bearings 66, wear caused by the offset of the inner ring 64 can be suppressed by the reduction of the amount of thrust Δ. The aforementioned configuration can contribute to an improvement in durability.

Furthermore, the lubricant oil from the pump 9 is supplied into the drive rotor 10, and is introduced into the ball bearing roller 60 through the open end 60*a* in the axial direction between the outer ring 62 and the inner ring 64. For this reason, during a cold temperature, the lubricant oil becomes resistant to rolling contact in the contact interface between the outer ring 62 and the entirety of the ball bearings 66 and in the contact interface between the inner ring 64 and the entirety of the ball bearings 66. However, since the total contact area between the outer ring 62 and the entirety of the ball bearings 66 and the total contact area between the inner ring 64 and the entirety of the ball bearings 66 are small in the single-row ball bearing roller 60, total resistance in the entire contact interface caused by the lubricant oil during a cold temperature can be reduced. Accordingly, the resistance of the lubricant oil is prevented from disturbing the rolling contact in the ball bearing roller 60, thereby improving responsiveness of adjustment of the rotor-to-rotor phase or responsiveness of adjustment of the valve timing based on the planetary motion of the geared rotor 30.

Furthermore, in the driven rotor 20 to which the cam torque is transmitted from the cam shaft 2, the cam torque is converted at the locations where the driven inner gear portion 24 and the geared rotor 30 mesh with each other, and thus the radial load Fc is exerted on the first region 401 of the planetary carrier 40. Accordingly, the planetary carrier 40 is tilted around the specific point R in the second region 402 by the exertion of the radial load Fc. However, when the geared rotor 30 is tilted together with the planetary carrier 40 and the inner ring 64 at the angle θ which is smaller than the maximum allowable angle of the inner ring 64 to be brought into contact with the driven rotor 20, effects of the tilt regulation and effects of suppression of the contact pressure can be realized. Accordingly, even in the cam torque transmission structure that causes the radial load Fc, wear of the ball bearing roller 60 can be suppressed, thereby durability can be improved.

The pair of elastic members 50 installed between the geared rotor 30 and the planetary carrier 40 biases the geared rotor 30 toward the locations where the geared rotor 30 meshes with the inner gear portions 12 and 24, and thus wear in each meshing location caused by gear rattle can be suppressed. The pair of elastic members 50 biases the planetary carrier 40 toward the side opposite to the geared rotor 30 by the biasing force, and the biasing force as the radial load Fu is exerted on the first region 401 of the planetary carrier 40. Accordingly, the planetary carrier 40 is tilted around the specific point R in the second region 402. However, when the geared rotor 30 is tilted together with the planetary carrier 40 and the inner ring 64 at the angle θ which is smaller than the maximum allowable angle of the inner ring 64 to be brought into contact with the driven rotor 20, effects of the tilt regulation and effects of suppression of the contact pressure can be realized. Accordingly, even in a structure of biasing force being exerted, which causes the radial load Fu, wear of the ball bearing roller 60 can be suppressed, thereby durability can be improved.

In First Embodiment described above, the driven rotor 20 is equivalent to "a first rotor rotatably coupled with the cam shaft", and the driven inner gear portion 24 is equivalent to "a first gear portion". The drive rotor 10 is equivalent to "a second rotor rotatably coupled with the crank shaft", the drive inner gear portion 12 is equivalent to "a second gear portion", and the lubricant oil supplied into the drive rotor 10 from the pump 9 is equivalent to "lubricant liquid".

(Second Embodiment)

Figure 8:
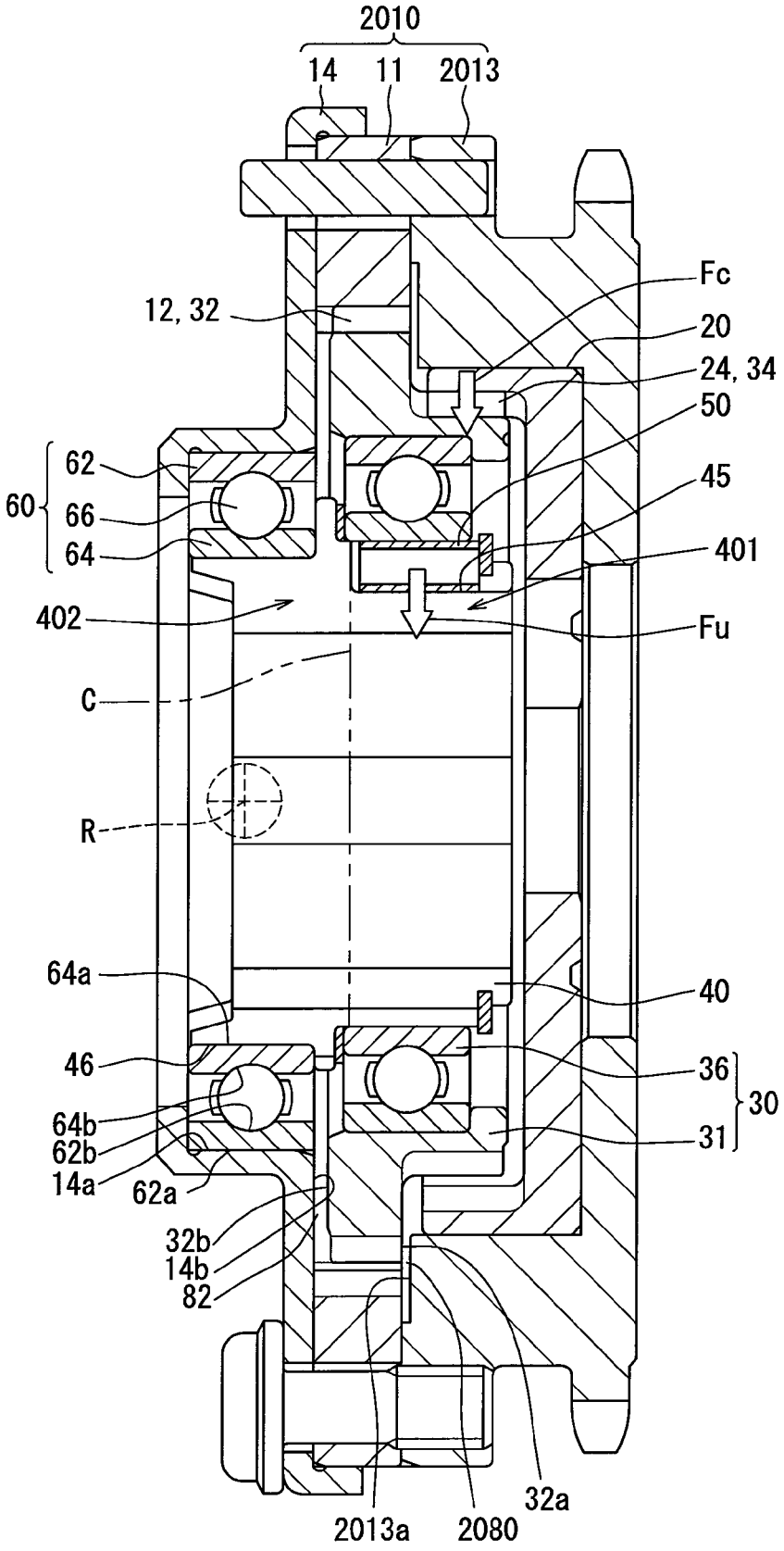
FIG. 8 is an enlarged cross-sectional view illustrating main portions of a valve timing adjustment apparatus according to Second Embodiment.

As illustrated in FIG. 8, Second Embodiment of the present disclosure is a modification example of First Embodiment. In an initial state of the geared rotor 30 according to Second Embodiment, the end surface 32*a* faces an open end surface 2013*a* of a circumferential wall portion of a sprocket member 2013 of a drive rotor 2010 in the axial direction. In this case, an axial clearance 2080 is formed entirely in the rotational direction (in the circumferential direction) between the end surfaces 32*a* and 2013*a*. Here, similarly to in First Embodiment, the clearance 82 is formed between the end surfaces 32*b* and 14*b*, and is greater than the clearance 2080. Accordingly, the radial loads Fc and Fu are exerted on the planetary carrier 40, and thus the outermost circumferential angled portion 32*c* in the eccentric side of the end surface 32*a* of the geared rotor 30, which is tilted together with the planetary carrier 40, is elastically deformed and is brought into contact with the open end surface 2013*a*. That is, the outermost circumferential angled portion 32*c* of the end surface 32*a* of the geared rotor 30 is brought into elastic contact with the open end surface 2013*a*.

Even in Second Embodiment, the radius Ra between the outermost circumferential angled portion 32*c* and the rotational center line O is set to be greater than the radius Rs between the supporting surface 46 and the rotational center line O. When the outermost circumferential angled portion 32*c* is brought into contact with the open end surface 2013*a*, the tilt angle θ relative to the axial direction of the geared rotor 30 is set to be smaller than the maximum allowable angle of the inner ring 64. Accordingly, a contact target of the geared rotor 30 is changed from the driven rotor 20 to the drive rotor 2010, but the same effects described in First Embodiment can be realized.

(Other Embodiments)

The plurality of embodiments are described above, but the present disclosure is not limited to the embodiments. Various embodiments and combinations thereof can be applied insofar as the embodiments and the combinations do not depart from the scope of the present disclosure.

Specifically, Modification Example 1 may have a changed structure in which the driven rotor 20 rotates coupled with the crank shaft, and the rotor 10 rotates coupled with the cam shaft. In this case, the cam torque is transmitted to the rotor 10 as "the second rotor" from the cam shaft 2.

In Modification Example 2, a ball bearing roller with the columnar rolling element 66 may be adopted as the single-row ball bearing roller 60. Modification Example 3 may adopt a configuration in which the lubricant oil is not introduced into the ball bearing roller 60. Here, particularly in Modification Example 3, for example, a closed end type radial bearing with both closed ends may be adopted as the single-row ball bearing roller 60. Alternatively, Modification Example 3 may adopt a structure in which the lubricant oil is not supplied into the rotor 10, or a structure in which the lubricant oil is supplied into the rotor 10, but does not reach the ball bearing roller 60.

Modification Example 4 may adopt a structure in which one elastic member 50 is provided or a plurality of the elastic members 50 are provided as far as the radial load Fu can be generated by the biasing force. In contrast, Modification Example 5 may adopt a structure in which the elastic member 50 is not provided.

In Modification Example 6, the radius Ra between the outermost circumferential angled portion 32*c* and the rotational center line O may be set to be smaller than or equal to the radius Rs between the supporting surface 46 and the rotational center line O. In addition to the embodiments and the modification examples which illustrate the apparatus that adjusts the valve timing of the intake valve, in Modification Example 7, the present disclosure may be applied to an apparatus which adjusts valve timing of an exhaust valve as the "valve" or which adjusts valve timing of both intake valve and exhaust valve.

What is claimed is:

1. A valve timing adjustment apparatus for adjusting valve timing of a valve, the valve being opened and closed by a rotation of a cam shaft, the cam shaft being rotated by torque transmitted from a crank shaft in an internal combustion engine, the valve timing adjustment apparatus comprising:

a first rotor having a first gear portion and rotatably coupled with one of the crank shaft or the cam shaft;

a second rotor having a second gear portion and interposing the first rotor on both sides in an axial direction, the second rotor rotatably coupled with an other of the crank shaft or the cam shaft;

a geared rotor meshing with the first gear portion and the second gear portion and moving in planetary motion to adjust a relative phase between the first rotor and the second rotor;

a planetary carrier supporting the geared rotor in a radial direction from an inside of the geared rotor, and receiving a radial load in a first region, the first region being offset to one end from a center position of the planetary carrier in the axial direction; and a ball bearing roller that is supported by the second rotor and supports the planetary carrier in the radial direction from an outside of the planetary carrier in a second region, the second region being offset to an other end from the center position of the planetary carrier in the axial direction, wherein the ball bearing roller is a single-row ball bearing roller that has an outer ring supported by the second rotor, an inner ring that supports the planetary carrier, and a plurality of ball bearings that are rotatably installed in a single row to be in contact with and between the outer ring and the inner ring, the geared rotor is tilted relative to the axial direction by the radial load and brought into contact with the first rotor or the second rotor in the axial direction, and an angle of the geared rotor relative to the axial direction is set to be smaller than a maximum allowable angle at which the inner ring is allowed to be tilted relative to the axial direction.

2. The valve timing adjustment apparatus according to claim 1, wherein the geared rotor is eccentric with respect to the first rotor and the second rotor, and an outermost circumferential angled portion on eccentric side of the geared rotor is brought into elastic contact with the first rotor or the second rotor, the planetary carrier has a supporting surface coaxial with the first rotor and the second rotor and supports the inner ring with the supporting surface, and a radius between a rotational center line of the first rotor and the second rotor and the outermost circumferential angled portion is set to be greater than a radius between the rotational center line and the supporting surface.

3. The valve timing adjustment apparatus according to claim 1, wherein the ball bearing roller has an open end between the outer ring and the inner ring that opens in the axial direction, and lubricant liquid supplied into the second rotor is introduced into the ball bearing roller through the open end.

4. The valve timing adjustment apparatus according to claim 1, wherein a cam torque transmitted from the cam shaft to the first rotor or the second rotor is converted into the radial load at locations where the geared rotor meshes with the first gear portion or the second gear portion.

5. The valve timing adjustment apparatus according to claim 1, further comprising:

an elastic member that is installed between the geared rotor and the planetary carrier to bias the geared rotor toward the locations where the geared rotor meshes with the first gear portion and the second gear portion, wherein the radial load is generated by a biasing force by which the elastic member biases the planetary carrier toward a side opposite to the geared rotor.

* * * * *